US006024541A

United States Patent [19]

Perstnev et al.

[11] Patent Number: 6,024,541

[45] Date of Patent: Feb. 15, 2000

[54] HYDRAULIC AXIAL PISTON PUMPS

[75] Inventors: Alexander Perstnev; Samuel Perstnev, both of Kiryat Malachi, Israel

[73] Assignee: Nordip Ltd., Ashkelon, Israel

[21] Appl. No.: 09/056,030

[22] Filed: Apr. 6, 1998

[51] Int. Cl.[7] ..... F04B 1/12

[52] U.S. Cl. ..... 417/269; 417/203; 417/222.1; 417/270; 417/312; 91/6.5; 91/487; 91/506; 91/499; 91/28; 92/57; 92/12.2; 92/47; 92/71

[58] Field of Search ..... 417/203, 222.1, 417/269, 270, 312; 91/6.5, 28, 487, 499, 506; 92/12.2, 47, 57, 71

[56] References Cited

U.S. PATENT DOCUMENTS

| | | | |
|---|---|---|---|
| 3,585,901 | 6/1971 | Moon, Jr. et al. | 91/6.5 |
| 3,682,044 | 8/1972 | Ankeny et al. | 91/487 |
| 4,096,786 | 6/1978 | Schauer . | |
| 4,175,472 | 11/1979 | Roberts | 91/6.5 |
| 4,489,642 | 12/1984 | Westveer . | |
| 4,508,011 | 4/1985 | Nolden | 91/506 |
| 4,771,676 | 9/1988 | Matsumoto et al. | 92/57 |
| 4,838,765 | 6/1989 | Wusthof et al. | 417/203 |
| 5,358,388 | 10/1994 | Schutten et al. | 417/269 |
| 5,538,401 | 7/1996 | Schaffner et al. | 417/222.1 |
| 5,593,285 | 1/1997 | Watts | 417/269 |
| 5,634,776 | 6/1997 | Leemhuis et al. | 417/270 |

*Primary Examiner*—John A. Jeffery
*Assistant Examiner*—L. Fastovsky
*Attorney, Agent, or Firm*—Ostrolenk, Faber, Gerb & Soffen, LLP

[57] ABSTRACT

A hydraulic axial pump/motor comprises a plurality of revolving as well as reciprocating pistons, operatively associated with a stationary port plate. The port plate comprises at least a first, elongated, arcuate suction port and at least a second elongated, arcuate discharge port, divided by a bringing portion extending between the downstream side of the suction port and the upstream side of the discharge port. A tortuous passage of a non-uniform cross-section is formed in the bridging portion, allowing the by-passing of the fluid first in a direction towards the downstream side of the suction port and then towards and into the upstream side of the discharge port.

12 Claims, 5 Drawing Sheets

HYDRAULIC AXIAL PISTON PUMPS

BACKGROUND OF THE INVENTION

The present invention relates to hydraulic piston axial pumps/motors of the type comprising pistons reciprocating within a rotatable cylinder block. Suction and discharge are both conducted via a common port plate, over which the pistons are revolved.

It has been for long recognized that these pumps suffer the inherent drawback of producing noise at such high db. levels that may cause damage to the human ear.

Several attempts have been made to solve this problem—cf U.S. Pat. No. 4,489,642 (Westveer—Dec. 25, 1984) and U.S. Pat. No 4,096,786 (Schauer—Jan. 29, 1978), both pointing at the solution in the direction of partly relieving the pressure shortly before the commence of the full discharge stage.

The object of the present invention is to improve the achievement of noise reduction along the line of the above concept.

SUMMARY OF THE INVENTION

Thus provided according to the invention is a hydraulic axial pump or motor comprising a plurality of revolving as well as reciprocating pistons, operatively associated with a stationary port plate. The plate comprises at least a first, elongated, arcuate suction port and at least a second elongated, arcuate discharge port, divided by a bridging portion extending between the downstream side of the suction port and the upstream side of the discharge port. A tortuous passage of a non-uniform cross-section is formed in the bridging portion, allowing the by-passing of the fluid first in a direction towards the downstream side of the suction port and then towards and into the upstream side of the discharge port.

In practice, the passage is preferably formed with two widened sections, connected in series, each serving a flow impact cushioning chamber.

The chambers may be located either in alignment or in side-by-side relative positions.

The volume of the first-in-line chamber is preferably 2–3 times greater than the volume of the second chamber.

BRIEF DESCRIPTION OF THE DRAWINGS

These and additional features and advantages of the invention will become more clearly understood in the light of the following description of preferred embodiments thereof, given by way of example only, with reference to the accompanying drawings, wherein.

DETAILED DESCRIPTION OF THE PREFERRED EMBODIMENTS

Figure 2:
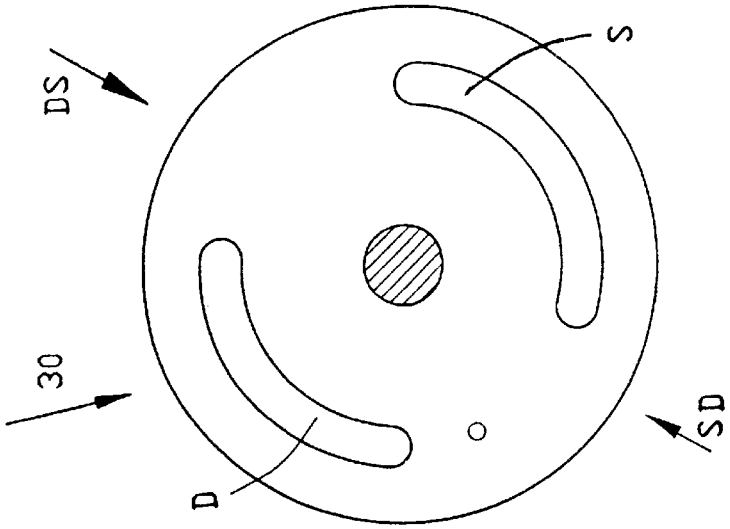
FIG. 2 is a plan view of the port plate taken along line II—II of FIG. 1.
Figure 1:
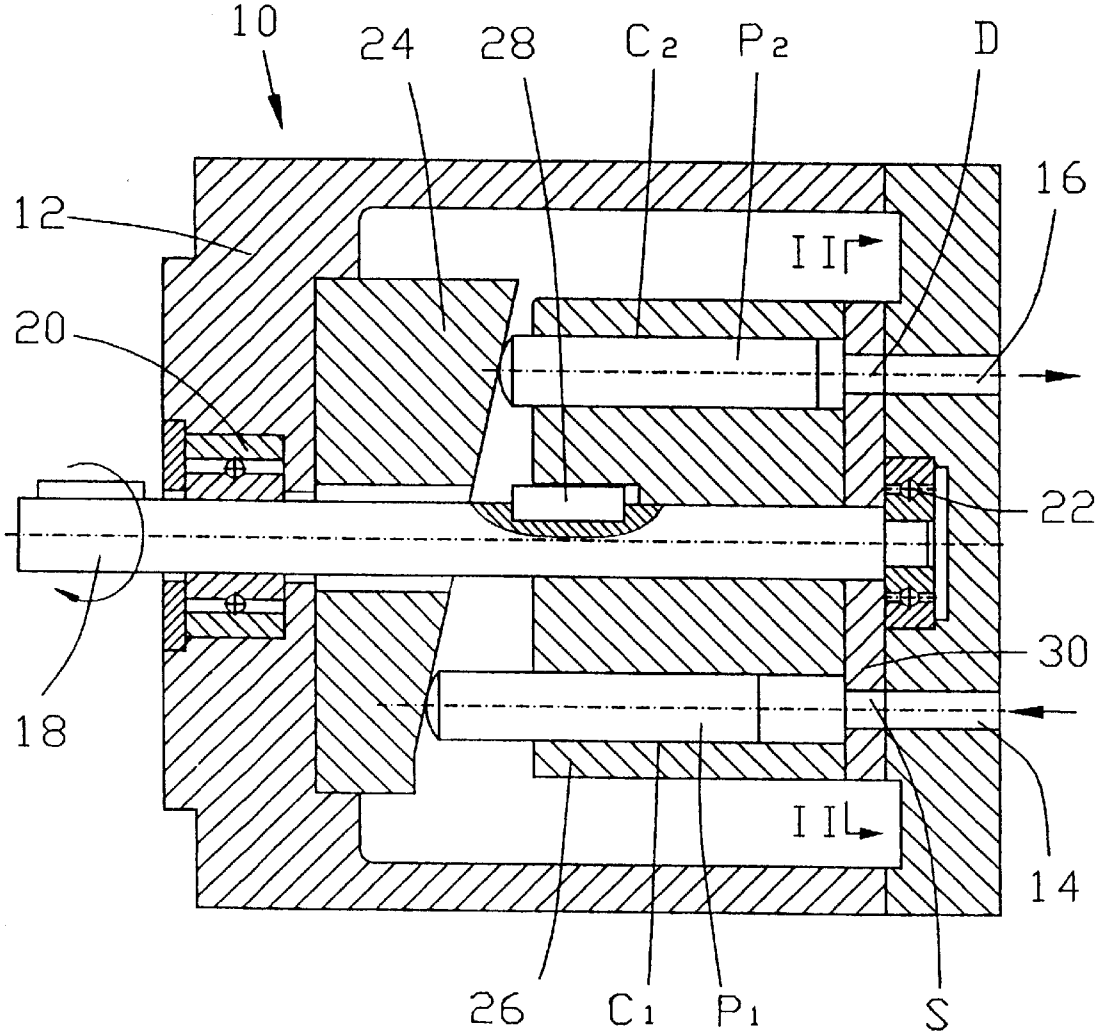
FIG. 1 is a schematic axial cross-section of a typical axial piston pump.
Figure 3:
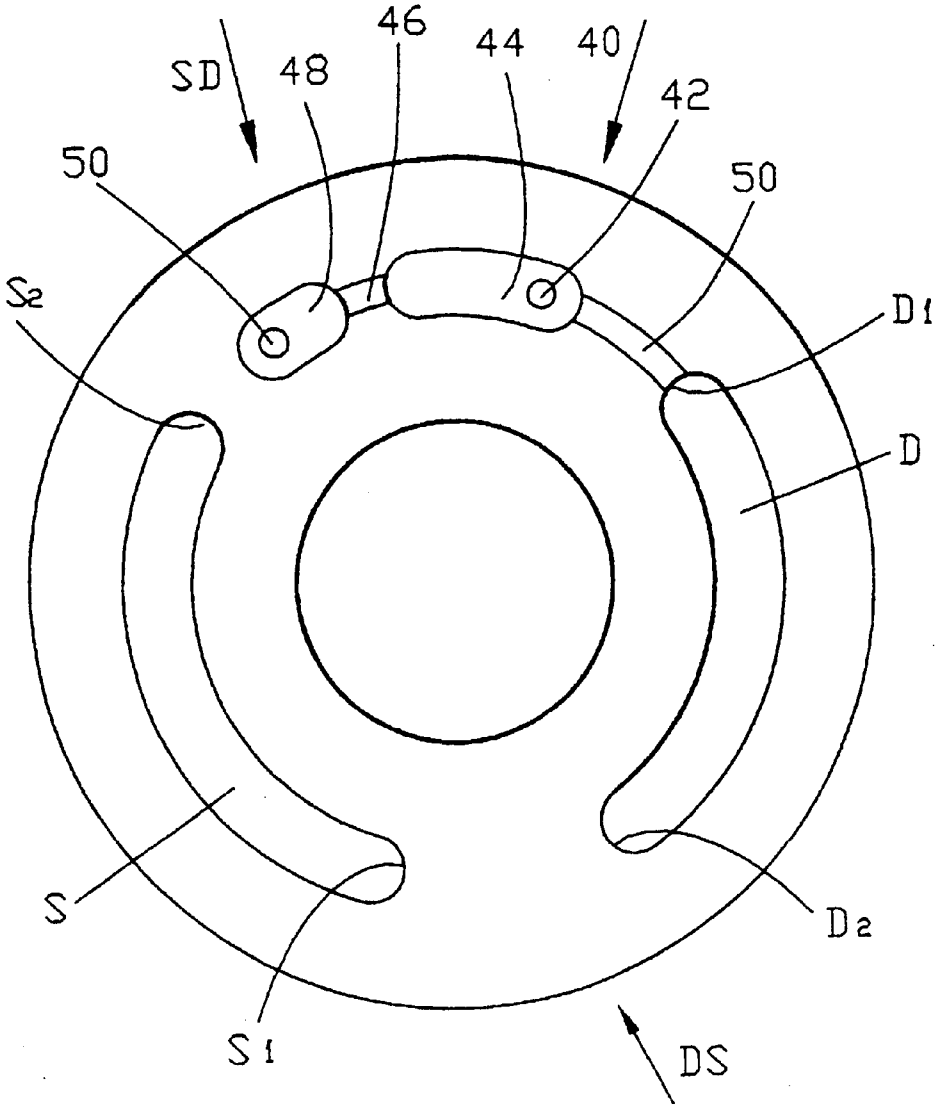
FIG. 3 shows a port plate incorporating the improvement according to one preferred embodiment of the present invention.

As is highly schematically shown in FIG. 1, axial pump 10 comprises housing 12 with hydraulic fluid inlet 14 and outlet 16. A driving shaft 18 is rotatably mounted by bearings 20 and 22.

A fixed tilted plate 24 is provided, for applying the reciprocal motion of one or more pistons, two of which are shown denoted $P_1$ and P2.

The pistons are slidable within cylinders $C_1$, $C_2$ comprised in cylinder block 26, which is coupled, as by key 28 to the driving shaft 18.

Port plate 30, installed as known, comprises arcuate suction and discharge slots designated S and D, respectively, with solid bridge-over portions SD and DS.

Figure 5:
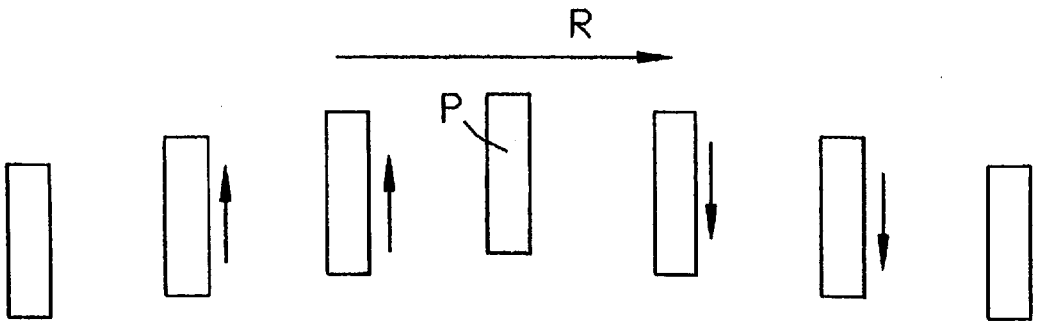
FIG. 5 is a kinematic representation of the piston positions relative to the layout of FIG. 4.
Figure 4:
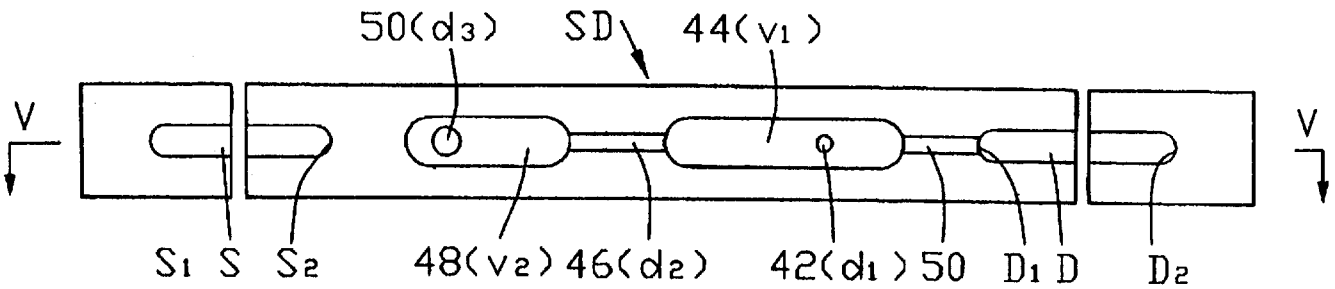
FIG. 4 is a linear projection of the layout of the plate of FIG. 3.
Figure 6:
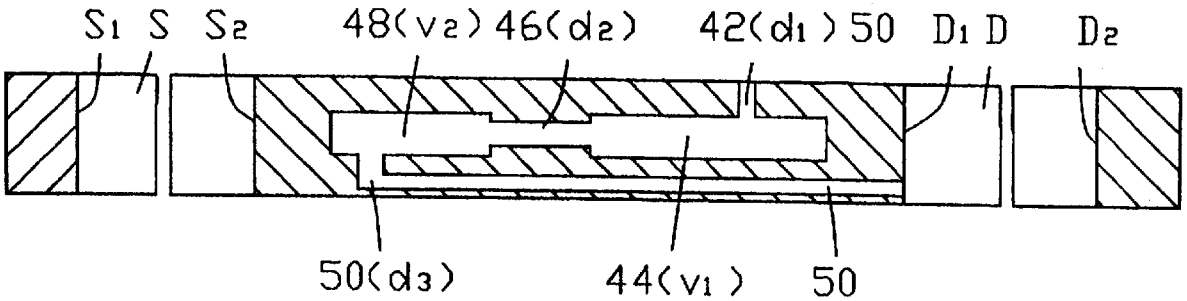
FIG. 6 is a section taken along line V—V of FIG. 4.

In the position illustrated in FIG. 1, piston $P_1$ approaches the end of the suction stroke, whereas piston $P_2$ completes the discharge stroke (see also FIG. 5).

Turning now to FIGS. 3–6, it will be readily seen that the improvement proposed according to the invention resides in idea to partly break or relief the high pressure of the discharge stroke, by a by-pass stage preceding the full discharge through slot D.

Hence, the bridging portion SD of port plate 40, extending between the downstream end $S_2$ of the suction slot S and the upstream side $D_1$ of the discharge slot D, is formed with a first passage 42, leading to a first hydraulic impact absorbing or cushioning chamber 44.

The chamber 44 may be directly connected to the upstream side $D_1$ of the discharge slot D (not shown); however, mathematical analysis has proved that the optimal noise attenuation results are gained by providing a pair of such serially connected chambers, and therefore this configuration is further exemplified.

Thus, a second passage 46 leads to a second chamber 48, and a third passage 50 leads back to the discharge slot D.

The fact that the fluid is caused to flow through a generally tortuous or labyrinth path, first in a direction opposite to the pistons revolving direction (denoted by arrow R in FIG. 5) is of essence.

Analytical considerations have further proven that the following preferable proportions should be observed:

(i) $d_1 < d_2 \leq d_3$ where $d_1$ is the diameter (or cross-sectional area) of the passage 42, $d_2$—of passage 46 and $d_3$—of passage 50;

(ii) $d_1$=0.5 mm—1.2 mm;

and (iii) $V_1/V_2$=2:3

Where $V_1$ is the volume of chamber 44 and $V_2$ is the volume of chamber 48.

The noise reduction achieved varied between a maximum of about 10 db at the range of about 15,000–20,000 Hz, down to a minimum of about 6 db. at about 1,000 Hz.

Figure 7:
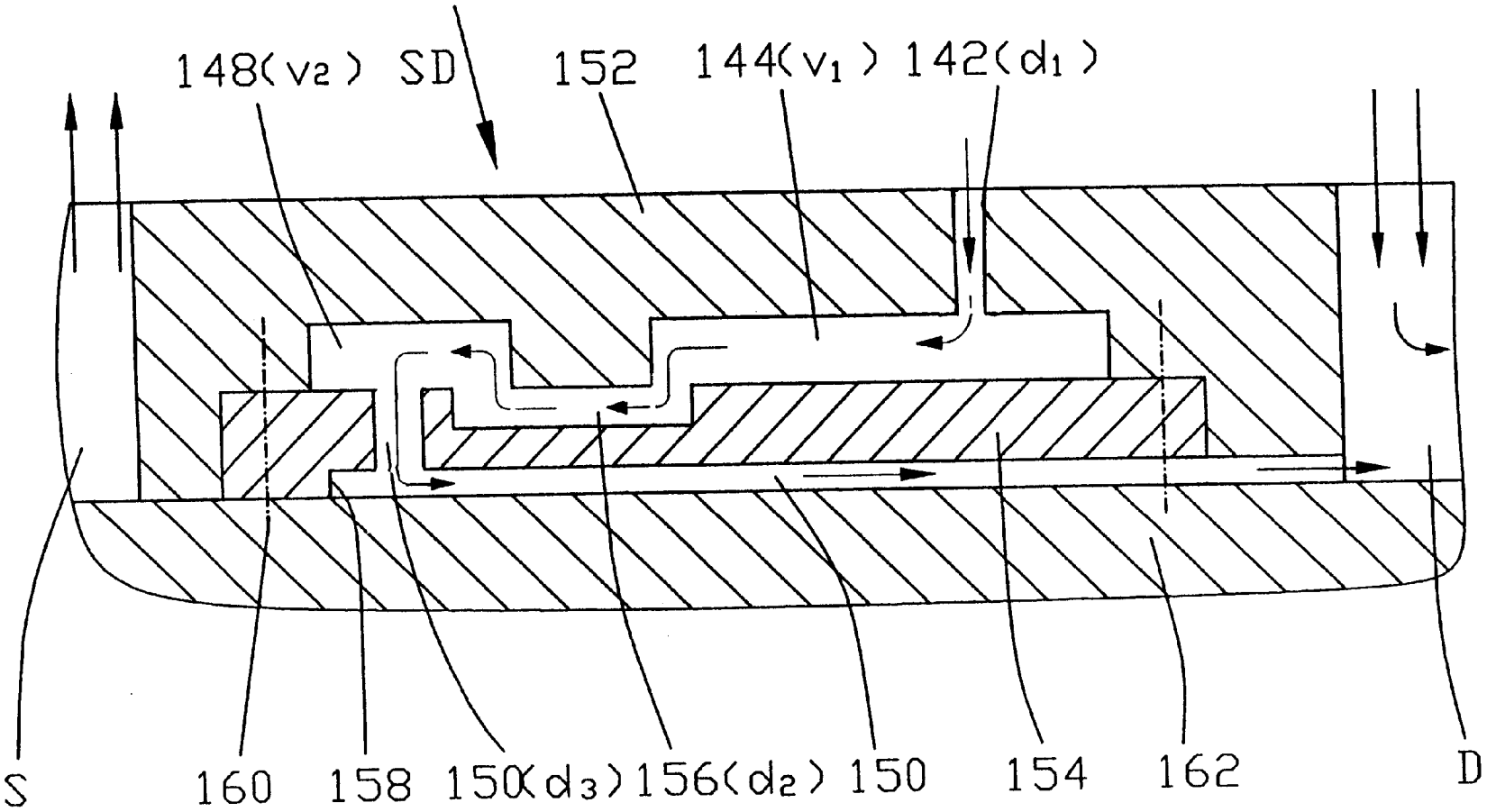
FIG. 7 is a sectional view exemplifying the reduction into practice of the structure of FIG. 6.

The implementation of the chamber design can be rather simply applied in the manner depicted in FIG. 7, bearing in mind that the port plate 140 is made of hardened steel.

Thus, the bore 142, and chambers 144 and 148 are machined from the bottom side of the plate, leaving a partition 152; a cover plate 154, with a depression 156 at the upper side, and depression 158 at the other side thereof, is positioned and fastened by screws 160. The depression 158, together with side wall portion 162 of the pump housing (see FIG. 1) will complete the passage 150.

Figure 9:
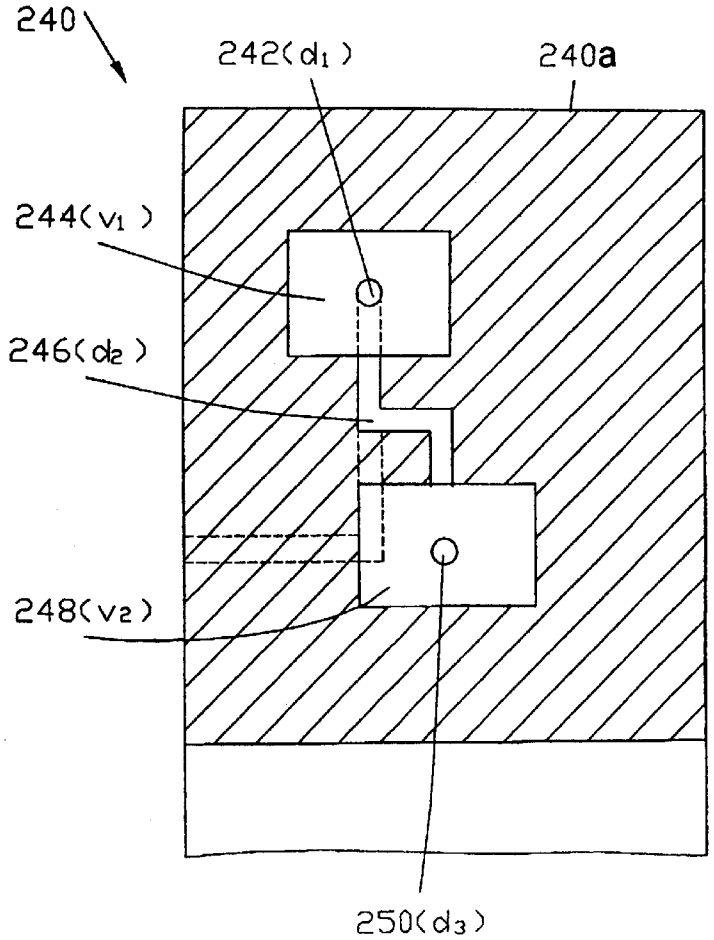
FIG. 9 is a sectional view taken along line IX—IX of FIG. 8.
Figure 8:
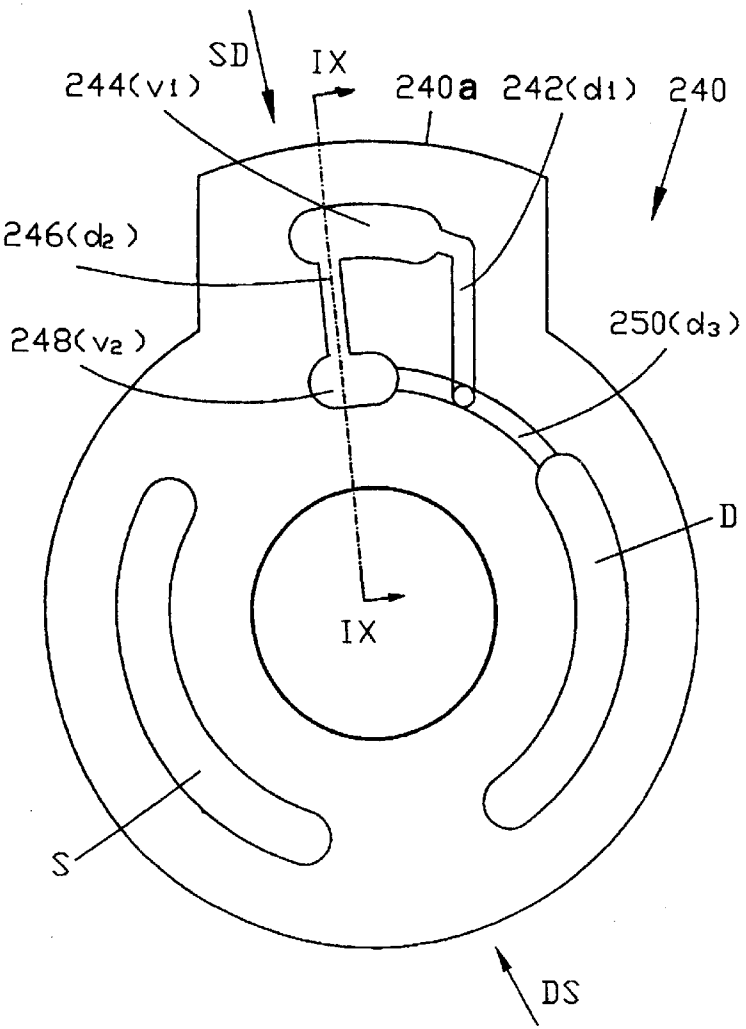
FIG. 8 illustrates a modified embodiment of the invention.

According to a modified embodiment illustrated in FIGS. 8 and 9, the double-chamber structure is applied in a side-by-side configuration, though at different levels.

The first chamber 244 is located within a bulging portion 240*a* projecting from the circumference of the port plate 240. The hydraulic fluid is again by-passed prior to its discharge stage through bore and passage 242 leading to the chamber 244, and then through passage 246 to the second chamber 248, and finally through passage 250 to the discharge slot D.

It will be noted that the passage 246 is stepped-down to a lower level (see FIG. 9), allowing the passage 250 to run underside the bore 242. Other layout designs are of course applicable.

Various changes and modifications of the invention will be apparent.

What is claimed is:

1. A hydraulic axial pump or motor comprising a plurality of revolving as well as reciprocating pistons, operatively associated with a stationary port plate having at least a first, elongated, arcuate suction port and at least a second elongated, arcuate discharge port, divided by a bridging portion extending between the downstream side of the suction port and the upstream side of the discharge port, a tortuous passage of a non-uniform cross-section being formed in the bridging portion allowing the by-passing of the fluid first in a direction towards the downstream side of the suction port and then towards and into the upstream side of the discharge port.

2. The pump of claim 1 wherein the passage comprises at least one widened section serving a flow impact cushioning chamber.

3. The pump of claim 2 comprising two cushioning chambers.

4. The pump of claim 3 wherein the volume $V_1$ of the first chamber is greater than the volume $V_2$ of the second chamber.

5. The pump of claim 4 wherein the ratio $V_1/V_2$ is between 2–3.

6. The pump of claim 5 wherein a first passage section extends between the face surface of the port plate and the first chamber, a second passage section extends between the first and the second chambers, and a third passage section extends between the second chamber and the discharge port.

7. The pump of claim 6 wherein the chambers and the passage sections are axially aligned in a common arcuate plane.

8. The pump of the claim 7 wherein the cross-sectional area of the second passage section is smaller than the cross-sectional area of the third passage section.

9. The pump of claim 6 wherein the cross-sectional area of the first passage section is smaller than the cross-sectional area of the second passage section.

10. The pump of claim 3 wherein at least one of the chambers is located at a radially bulging portion of the port plate.

11. The pump of claim 10 wherein said one of the chambers is the first chamber.

12. The pump of claim 10 wherein the chambers extend in axial parallel directions, and in spaced radial planes of the plate.

* * * * *